US005708321A

United States Patent [19]

Joo et al.

[11] Patent Number: 5,708,321

[45] Date of Patent: Jan. 13, 1998

[54] CATHODE FOR ELECTRON TUBE HAVING AN ELECTRON-EMISSION LAYER INCLUDING A LANTHANUM-MAGNESIUM-MANGANESE OXIDE

[75] Inventors: Kyu-nam Joo; Jong-seo Choi; Kwi-seuk Choi; Geun-bae Kim; Sang-won Lee, all of Suwon, Rep. of Korea

[73] Assignee: Samsung Display Devices Co., Ltd., Kyungki-do, Rep. of Korea

[21] Appl. No.: 629,872

[22] Filed: Apr. 10, 1996

[30] Foreign Application Priority Data

Oct. 30, 1995 [KR] Rep. of Korea ..... 95-38226

[51] Int. Cl.[6] ..... H01J 1/13

[52] U.S. Cl. ..... 313/346 R; 313/337; 313/270

[58] Field of Search ..... 313/346 R, 346 DC, 313/270, 337, 234; 252/521, 518

[56] References Cited

U.S. PATENT DOCUMENTS 4,797,593 1/1989 Saito et al. ..... 313/346

4,885,211 12/1989 Tang et al. ..... 313/504

5,146,131 9/1992 Derks ..... 313/346 R

FOREIGN PATENT DOCUMENTS 2294155 4/1996 United Kingdom .

*Primary Examiner*—Elizabeth L. Dougherty

*Assistant Examiner*—Harshad Patel

*Attorney, Agent, or Firm*—Leydig, Voit & Mayer, Ltd.

[57] ABSTRACT

A cathode for an electron tube includes a base metal containing nickel as a major component and an electron-emissive material layer which is formed on the base metal and comprises an alkaline earth metal oxide including barium oxide as its main component, wherein the electron-emissive material layer further comprises a lanthanum-magnesium-manganese oxide. The cathode of the present invention is fully interchangeable with conventional oxide cathodes and has a longer lifetimes and an improved cut-off drift characteristic.

5 Claims, 2 Drawing Sheets

CATHODE FOR ELECTRON TUBE HAVING AN ELECTRON-EMISSION LAYER INCLUDING A LANTHANUM-MAGNESIUM-MANGANESE OXIDE

BACKGROUND OF THE INVENTION

The present invention relates to a cathode for an electron tube, and more particularly, to a cathode having an enhanced lifetime and an improved cut-off drift characteristic for an electron tube such as a cathode-ray tube or an image pickup tube.

FIG. 1 is a schematic sectional view illustrating a conventional cathode for an electron tube, having a disk-like base metal 2, a cylindrical sleeve 3 which is fitted to the lower part of base metal 2 for support and is internally provided with a heater 4 for heating the cathode, and an electron-emissive material layer 1 being coated on the base metal.

Electron-emissive material layer 1 is generally formed of an alkaline earth metal oxide which includes Ba oxide as its main component, preferably a ternary metal oxide represented as (Ba,Sr,Ca) O.

Electron-emissive material layer 1 is formed on the base metal 2 as follows: First, mixed powder of barium carbonate, strontium carbonate and calcium carbonate is dissolved in an organic solvent such as nitrocellulose or the like to prepare a solution. The prepared solution is then coated on the base metal of a cathode for an electron tube by spraying or electrodeposition to form a carbonate coating layer. The inside of the electron-tube is provided with an electron gun employing the cathode for an electron tube and is heated to about 1,000° C. using heater in an exhaust process for creating an internal vacuum. During the exhaust process, carbonate is converted into an oxide, for example, barium carbonate is converted into barium oxide as shown in a following reaction:

$$BaCO_3 \rightarrow BaO + CO_2\uparrow \quad (1)$$

The cathode is named as "oxide cathode" because the carbonate is changed into the oxide by heating at a high temperature through the exhaust process.

During cathode operation, the barium oxide reacts with the reducing agent (silicon or magnesium contained in the base metal) in the interface between the base metal and the electron-emissive material layer, to generate free barium as follows:

$$BaO + Mg \rightarrow MgO + Ba\uparrow \quad (2)$$

$$4BaO + Si \rightarrow Ba_2SiO_4 + 2Ba\uparrow \quad (3)$$

The free barium contributes to electron emission. Here, MgO, $Ba_2SiO_4$ or the like is formed in the interface between the electron-emissive material layer and the metal base. These reaction products act as a barrier (an intermediate layer) preventing the diffusion of magnesium or silicon, which inhibits the generation of free barium emitting electrons. Thus, the intermediate layer results in a shortening of the lifetime of the oxide cathode. Further, there is another disadvantage in that a high resistance of the intermediate layer prevents the flow of current for emitting electrons, which limits current density.

Along with popular trends toward higher definition and larger screens for televisions and other devices using cathode-ray tubes, there has been an increasing need for cathodes having high current densities and longer lifetimes.

However, conventional oxide cathodes are not capable of satisfying this need due to the aforementioned disadvantages with respect to performance and lifetime.

An impregnating-type cathode is known for its high current-density and long lifetime, but the manufacturing process therefor is complex and its operating temperature is over 1100° C., that is, about 300° C. to 400° C. higher than that of the conventional oxide cathodes. Accordingly, since such a cathode should be made of a material having a much higher melting point and which is very expensive, its practical use is deterred.

Thus, a great deal of research has gone into lengthening the life of a conventional oxide cathode having a good practicability. For example, U.S. Pat. No. 4,797,593 discloses a technique for improving the lifetime of a cathode by dispersing $Sc_2O_3$, $Y_2O_3$ or the like into a conventional ternary carbonate. Also, Japanese Patent Laid-open Publication No. 64-41137 discloses a technique in which a rare earth metal oxide, $Eu_2O_3$, is included in an electron-emissive material layer to improve cathode lifetime. Here, the rare earth metal inhibits the generation of intermediate layer and the evaporation of free barium, which lead to the enhanced lifetimes of the cathode. However, the amount of electron emission of a cathode tends to fall off sharply after a predetermined period of operation time because the rare earth metal accelerates the sintering of oxide at the cathode's operating temperature. Thus, oxide is sintered to a hardened state, which results in the decrease in an area of a reaction site for a reducing agent, to thereby reduce the amount of emitted electrons. Thus, the above-described cathodes do not have a good cut-off drift characteristic. Moreover, these cathodes can not be produced by a conventional oxide cathode manufacturing process, so that the manufacturing process thereof needs to be modified to additionally include a cathode activation process for ensuring the steady and ample emission of electrons.

SUMMARY OF THE INVENTION

An object of the present invention is to provide a cathode for an electron tube whose lifetime and cut-off drift characteristic are improved drastically and whose manufacturing process is fully interchangeable with the processes for manufacturing a conventional cathode.

The object of the present invention is achieved by a cathode for an electron tube comprising a base metal containing nickel as a major component and an electron-emissive material layer which is formed on the base metal and comprises an alkaline earth metal oxide including barium oxide as its major component, wherein the electron-emissive material layer further comprises a lanthanum-magnesium-manganese oxide.

The lanthanum-magnesium-manganese oxide may be a mixture of La-oxide, Mg-oxide and Mn-oxide, or a mixture of La—Mg composite oxide and Mn-oxide, or a La—Mg—Mn composite oxide.

BRIEF DESCRIPTION OF THE DRAWINGS

The above object and advantages of the present invention will become more apparent by describing in detail a preferred embodiment thereof with reference to the attached drawings in which.

DETAILED DESCRIPTION OF THE INVENTION

The magnesium (Mg) and manganese (Mn) contained in the electron-emissive material layer according to the present invention serve to inhibit the rare earth metal from accelerating oxide sintering at the operating temperature of a cathode. Therefore, by addition of La, Mg and Mn in the electron-emissive material layer, oxide sintering is inhibited and electrons can be uniformly emitted for a long time, thereby improving the lifetimes and cut-off drift characteristics of a cathode.

Further, the La compound, Mg compound and Mn compound are also mixed with (Ba,Sr,Ca) $CO_3$ and then solvents of butanol, nitrocellulose or the like are added to the mixture to form a suspension. This suspension is applied to the base metal by means of spraying, electrodeposition or the like. Therefore, the manufacturing process for the cathode of the present invention is fully interchangeable with conventional process, which contributes to the practicability of the cathode of the present invention.

Figure 1:
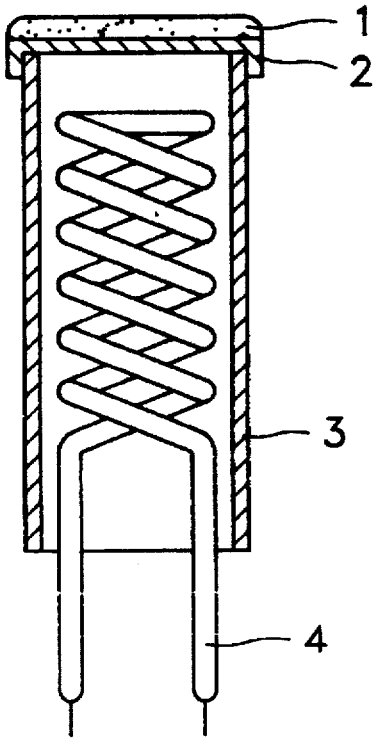
FIG. 1 is a schematic sectional view of a general cathode for an electron tube.

FIG. 1 is a sectional view of a general cathode for an electron tube as described above. The cathode according to the present invention has an electron-emissive substance layer formed on the base metal, which includes (Ba,Sr,Ca) O, and the lanthanum-magnesium-manganese oxide. Here, instead of coprecipitate-ternary oxide (Ba,Sr,Ca) O, a coprecipitate-binary oxide (Ba,Sr) O can be contained in the electron-emissive substance layer.

Preferably, the La—Mg—Mn oxide is formed from a mixture of La nitrate, Mg nitrate and Mn nitrate or a mixture of La—Mg nitrate and Mn nitrate or La—Mg—Mn composite nitrate.

Generally, nitrates such as $Ba(NO_3)_2$, $Sr(NO_3)_2$ and $Ca(NO_3)_2$ are dissolved in pure water and then coprecipitated in the solution by using a precipitator such as $Na_2CO_3$ or $(NH_4)_2CO_3$ to obtain a coprecipitate-ternary carbonate. At this time, various forms of carbonate crystal particles are achieved, according to the concentration or pH of the nitrate solution, the temperature during precipitation, and the rate of precipitation. In manufacturing the cathode of the present invention, an oxide having a capillary crystal structure (known as a preferred structure) can be obtained by controlling the above conditions.

Figure 2:
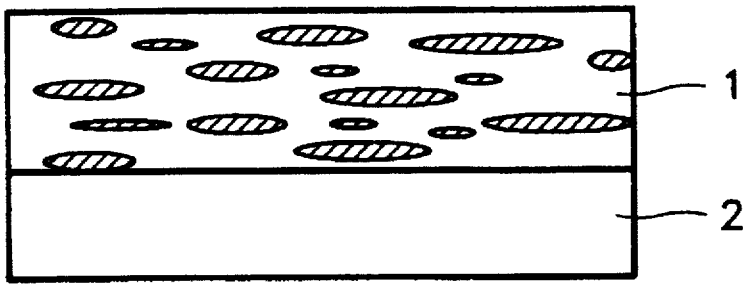
FIG. 2 is an enlarged sectional view illustrating a electron-emissive material layer of a conventional cathode for an electron tube which has ternary oxides having a capillary crystalline structure.

FIG. 2 is an enlarged sectional view illustrating an electron-emissive material layer of a conventional cathode for an electron tube which has a ternary oxides having a capillary crystalline structure.

In the cathode of the present invention, the amount of lanthanum-magnesium-manganese oxide with respect to the coprecipitate alkaline earth metal oxide is preferred to be 0.001 weight % to 20 weight %. Here, if the amount is less than 0.001 weight %, the lifetime-enhancing effect is slight, and if more than 20 weight %, the initial emission characteristic is poor.

Hereinbelow, the present invention is described more concretely with respect to specific examples intended to illustrate the instant invention without limiting the scope thereof.

EXAMPLE 1

Nitrates represented as $Ba(NO_3)_2$, $Sr(NO_3)_2$ and $Ca(NO_3)_2$ were dissolved in pure water and coprecipitated by using $Na_2CO_3$, to obtain a coprecipitate-ternary carbonate. Thereafter, 1.5 weight % of $La(NO_3)_3.6H_2O$, $Mg(NO_3)_2.6H_2O$ and $Mn(NO_3)_2.6H_2O$, respectively, based on the ternary carbonate, were added to the carbonate. The thus-obtained mixture was coated on the base metal. The cathode thus formed was inserted and fitted within an electron gun. The electron gun was sealed in the bulb of an electron tube and then subjected to an exhaust process to create an internal vacuum. Here, the carbonate of the electron-emissive substance layer is converted into an oxide by heater for heating the cathode, to thereby prepare the oxide cathode according to the present invention. Thereafter, an electron tube was completed by a conventional manufacturing process and its initial emission characteristic and cut-off drift voltage were estimated.

Figure 3:
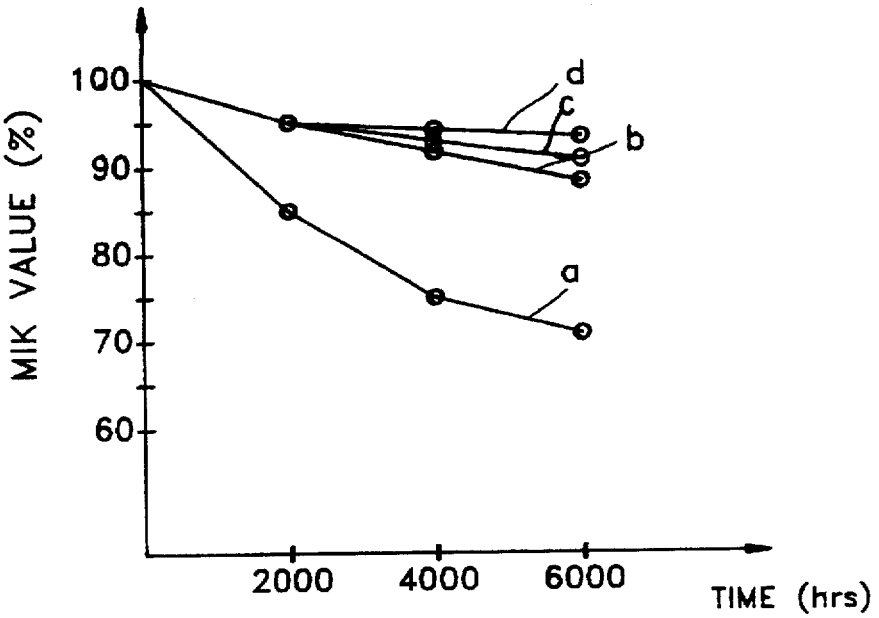
FIG. 3 is a graph showing lifetime characteristics of a cathode for an electron tube according to the present invention compared with that of a conventional cathode.

The initial emission characteristic was estimated as the maximum cathode current (called the "MIK value") and the lifetime of the cathode was determined by a residual rate of the initial MIK value over a given period (see FIG. 3). The cut-off drift characteristic was estimated a drifted amount of the cut-off voltage, corresponding to the initial MIK value, over a given period (see FIG. 4). Here, the picture quality worsens as the drifted amount increases.

EXAMPLE 2

A La—Mg nitrate and a Mn-nitrate prepared by separate processes were added to a ternary carbonate obtained in the same manner as Example 1. Here, La—Mg nitrate and Mg-nitrate were mixed uniformly to obtain $Mg_3La_2(NO_3)_{12}.24H_2O$. Then, 1.5 weight % of each La—Mg nitrate and Mn-nitrate based on the ternary carbonate was added to the ternary carbonate, followed by the same processes as Example 1, to produce the oxide cathode according to the present invention and the initial emission and cut-off drift voltage characteristics were estimated.

EXAMPLE 3

A La-nitrate, a Mg-nitrate and a Mn-nitrate were mixed uniformly to obtain a La—Mg—Mn nitrate. The La—Mg—Mn nitrate was added to a ternary carbonate obtained in the same manner as Example 1. Then, 1.5 weight % of the La—Mg—Mn nitrate based on the ternary carbonate was added to the ternary carbonate, followed by the same processes as Example 1, to produce the oxide cathode according to the present invention and the initial emission and cut-off drift voltage characteristics were estimated.

COMPARATIVE EXAMPLE

A conventional cathode was prepared in the same manner as Example 1 but without adding $La(NO_3)_3.6H_2O$, $Mg(NO_3)_2.6H_2O$ and $Mn(NO_3)_2.6H_2O$, and the initial emission and cut-off drift voltage characteristics were estimated.

Figure 4:
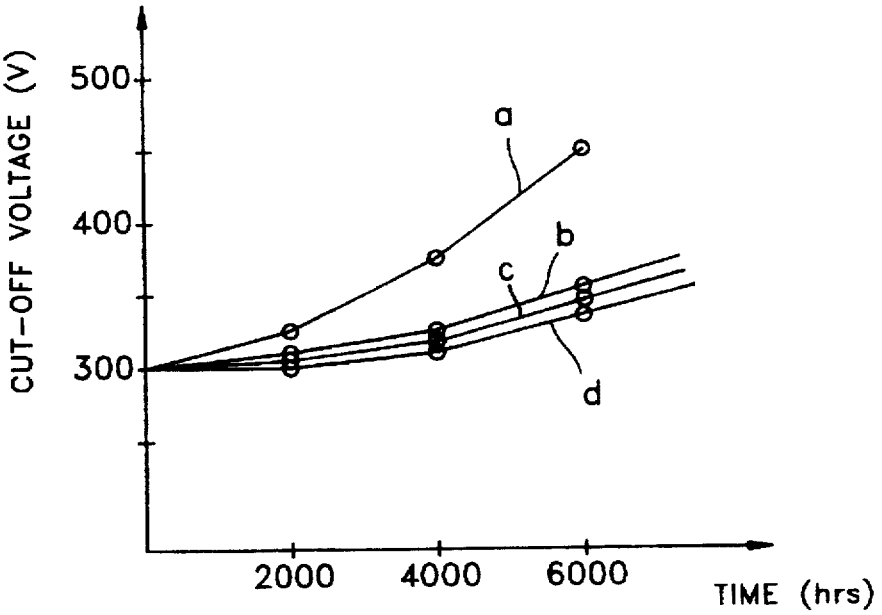
FIG. 4 is a graph showing cut-off drift characteristics of a cathode for an electron tube according to the present invention compared with that of a conventional cathode.

FIG. 3 illustrates lifetime characteristics and FIG. 4 illustrates cut-off drift characteristics of the oxide cathode according to the present invention compared with the conventional cathode. Here, the "a" curves illustrate characteristics of a cathode having an electron-emissive material layer containing only a conventional ternary oxide, the "b" curves correspond to a cathode in which the layer contains a conventional ternary oxide and lanthanum-magnesium-manganese oxide, the "c" curves correspond to a cathode in which the layer contains a conventional ternary oxide, and a La—Mg composite oxide and Mn-oxide, and the "d" curves correspond to a cathode in which the layer contains a conventional ternary oxide and La—Mg—Mn composite oxide.

As shown in FIGS. 3 and 4, the lifetime of the cathode according to the present invention was 15–20% longer than that of the conventional cathode and the cut-off drift voltage of the cathode according to the present invention was 10–25% less than that of the conventional cathode. Especially, the cathode in which the electron-emissive material layer contains La—Mg—Mn composite oxide has better lifetime and cut-off drift characteristics than that contains La—Mg composite oxide and Mn-oxide, which is better than that which contains La-oxide, Mg-oxide and Mn-oxide.

As shown in the above examples and the comparative example, the cathode of the present invention is a new oxide cathode, not only having a longer lifetime and better cut-off drift characteristic than the conventional cathode under equal conditions, but also enjoying full interchangeability with the processes for manufacturing the conventional oxide cathode. Accordingly, the cathode of the present invention overcomes the disadvantages of a short lifetime and poor picture quality which impede usage in large-screen high-definition tubes, thus the practicability to mass-production thereof can be accomplished without any change in process.

What is claimed is:

1. A cathode for an electron tube comprising a base metal containing nickel as a major component and an electron-emissive material layer provided on said base metal and comprising an alkaline earth metal oxide including barium oxide as its main component, wherein said layer further comprises a lanthanum-magnesium-manganese oxide.

2. A cathode for an electron tube as claimed in claim 1, wherein said lanthanum-magnesium-manganese oxide is a mixture of La-oxide, Mg-oxide and Mn-oxide.

3. A cathode for an electron tube as claimed in claim 1, wherein said lanthanum-magnesium-manganese oxide is a mixture of La—Mg composite oxide and Mn-oxide.

4. A cathode for an electron tube in accordance with claim 3, wherein an amount of said lanthanum-magnesium-manganese oxide is 0.001–20 weight % based on the alkaline earth metal oxide which includes barium oxide as its main component.

5. A cathode for an electron tube as claimed in claim 1, wherein said lanthanum-magnesium-manganese oxide is La—Mg—Mn composite oxide.

* * * * *